US011821165B2

(12) United States Patent
Risi

(10) Patent No.: US 11,821,165 B2
(45) Date of Patent: Nov. 21, 2023

(54) DIGGING EQUIPMENT AND OPERATING MACHINE

(71) Applicant: SIMEX S.R.L., San Giovanni in Persiceto (IT)

(72) Inventor: Mirco Risi, San Giovanni in Persiceto (IT)

(73) Assignee: SIMEX S.R.L., San Giovanni in Persiceto (IT)

( * ) Notice: Subject to any disclaimer, the term of this patent is extended or adjusted under 35 U.S.C. 154(b) by 629 days.

(21) Appl. No.: 17/048,943

(22) PCT Filed: Apr. 19, 2019

(86) PCT No.: PCT/IB2019/053270
§ 371 (c)(1),
(2) Date: Oct. 19, 2020

(87) PCT Pub. No.: WO2019/202567
PCT Pub. Date: Oct. 24, 2019

(65) Prior Publication Data

US 2021/0230831 A1 Jul. 29, 2021

(30) Foreign Application Priority Data

Apr. 20, 2018 (IT) ..... 102018000004753

(51) Int. Cl.
*E02F 5/08* (2006.01)
*E02F 5/14* (2006.01)
*E02F 9/00* (2006.01)

(52) U.S. Cl.
CPC ..... *E02F 5/14* (2013.01); *E02F 5/08* (2013.01); *E02F 9/006* (2013.01)

(58) Field of Classification Search
CPC ..... E02F 3/183; E02F 3/188; E02F 3/3681; E02F 5/08; E02F 5/14; E02F 9/006
See application file for complete search history.

(56) References Cited

U.S. PATENT DOCUMENTS 4,878,713 A 11/1989 Zanetis
5,864,970 A 2/1999 Maddock et al.
(Continued)

FOREIGN PATENT DOCUMENTS

DE 102008006426 A1 8/2009
EP 2246485 A1 11/2010
(Continued)

OTHER PUBLICATIONS

International Search Report and Written Opinion for International Patent Application No. PCT/IB2019/053270, dated Sep. 4, 2019, 12 pages.
(Continued)

*Primary Examiner* — Gary S Hartmann
(74) *Attorney, Agent, or Firm* — Armstrong Teasdale LLP

(57) ABSTRACT

A digging equipment includes a coupling portion coupling the digging equipment to an operating machine, an equipment body having abutment runners with a working surface, a digging tool movably mounted in the equipment body around a rotation axis (R), projecting partially frontally to the abutment runners and peripherally having a plurality of excavation elements. Adjustment means of the excavation depth of the digging equipment are functionally connected to the equipment body and to the digging tool to adjust a relative distance between the abutment runners and the plurality of excavation elements. Articulation means, mechanically interposed between the coupling portion and the digging tool allow the rotation axis (R) to move around an incident or orthogonal tilting axis (T) with respect to the rotation axis (R).

13 Claims, 4 Drawing Sheets

(56) References Cited

U.S. PATENT DOCUMENTS

| | | | | |
|---|---|---|---|---|
| 6,718,660 | B2 * | 4/2004 | Rivard | E02F 5/14 405/128.15 |
| 9,752,301 | B2 * | 9/2017 | Ruhl | E02F 3/183 |
| 10,337,168 | B2 * | 7/2019 | Sewell | E02F 5/14 |
| 10,358,792 | B2 * | 7/2019 | Risi | E02F 9/2271 |
| 10,655,302 | B2 * | 5/2020 | Sewell | E01C 23/0933 |
| 10,704,227 | B2 * | 7/2020 | Sewell | E02F 5/08 |
| 10,794,042 | B2 * | 10/2020 | Rivard | E02F 3/183 |
| 11,396,734 | B2 * | 7/2022 | Sewell | E02F 5/14 |
| 2002/0195869 | A1 | 12/2002 | Dybsetter | |
| 2009/0007460 | A1 * | 1/2009 | Greenlee | E02F 5/08 37/94 |
| 2017/0350093 | A1 | 12/2017 | Sewell | |

FOREIGN PATENT DOCUMENTS

| | | | |
|---|---|---|---|
| EP | 2735654 | A1 | 5/2014 |
| GB | 2468785 | A | 9/2010 |
| WO | 2014167319 | A2 | 10/2014 |

OTHER PUBLICATIONS

International Preliminary Report on Patentability for International Patent Application No. PCT/IB2019/053270, dated Jul. 22, 2020, 21 pages.

* cited by examiner

DIGGING EQUIPMENT AND OPERATING MACHINE

CROSS-REFERENCE TO RELATED APPLICATIONS

This application is a National Phase Application of PCT International Application No. PCT/IB2019/053270, having an International Filing Date of Apr. 19, 2019, which claims priority to Italian Application No. 102018000004753 filed Apr. 20, 2018, each of which is hereby incorporated by reference in its entirety.

FIELD OF THE INVENTION

The present invention relates to a digging equipment for an operating machine, and to an operating machine comprising such equipment. Digging equipment are known from US2017350093, WO2014167319, GB2468785, U.S. Pat. No. 4,878,713, EP2735654A1, EP2246485A1, U.S. Pat. No. 5,864,970A, US2002195869A1, DE102008006426A1.

BACKGROUND OF THE INVENTION

It is known to use digging devices that can be connected to excavators for making trenches, or for removing asphalt layers or the like.

A problem encountered in this sector is the difficulty of operating when the excavator moves on a non-horizontal plane since a track or a pair of wheels on the same side could be higher (or lower) than the opposite track or pair of wheels.

This situation occurs frequently when an excavation or a trench must be made for example near a step or a sidewalk, where there is not enough space for all the excavator tracks or wheels to rest on a single horizontal plane.

This drawback is even more accentuated in the case of narrow and relatively deep excavations, where a toothed disk must penetrate the material to be excavated substantially throughout the whole radius thereof, and where an inclination of the rotation axis of this disk would make it impossible to make a trench of this type, mainly due to impacts against the edges and side walls delimiting the trench.

Solutions known to these problems are in part known from U.S. Pat. No. 5,864,970A1, US2002/195869A1, EP2735654A1.

However, the need to manufacture trenches, even deep ones, having tortuous paths where the operating machine is inclined with respect to the trench digging plane remains strongly felt.

The present invention falls within the above context by aiming to provide a digging equipment and a digging assembly capable of overcoming the aforementioned drawbacks.

In particular, such digging equipment allows tilting the rotation axis of the excavation tool according to the needs, so that the positioning of the operating machine is indifferent for the purpose of carrying out excavations, even deep ones. In fact, the articulation means of such equipment can compensate or straighten out any tilting of the operating machine.

SUMMARY OF THE INVENTION

Such an object is achieved by a digging equipment and by a digging assembly as described and claimed herein. Preferred embodiments are also described.

BRIEF DESCRIPTION OF THE DRAWINGS

The object of the present invention will now be described in detail, with the aid of the accompanying drawings, provided by way of non-limiting example, in which.

DETAILED DESCRIPTION

Figure 1:
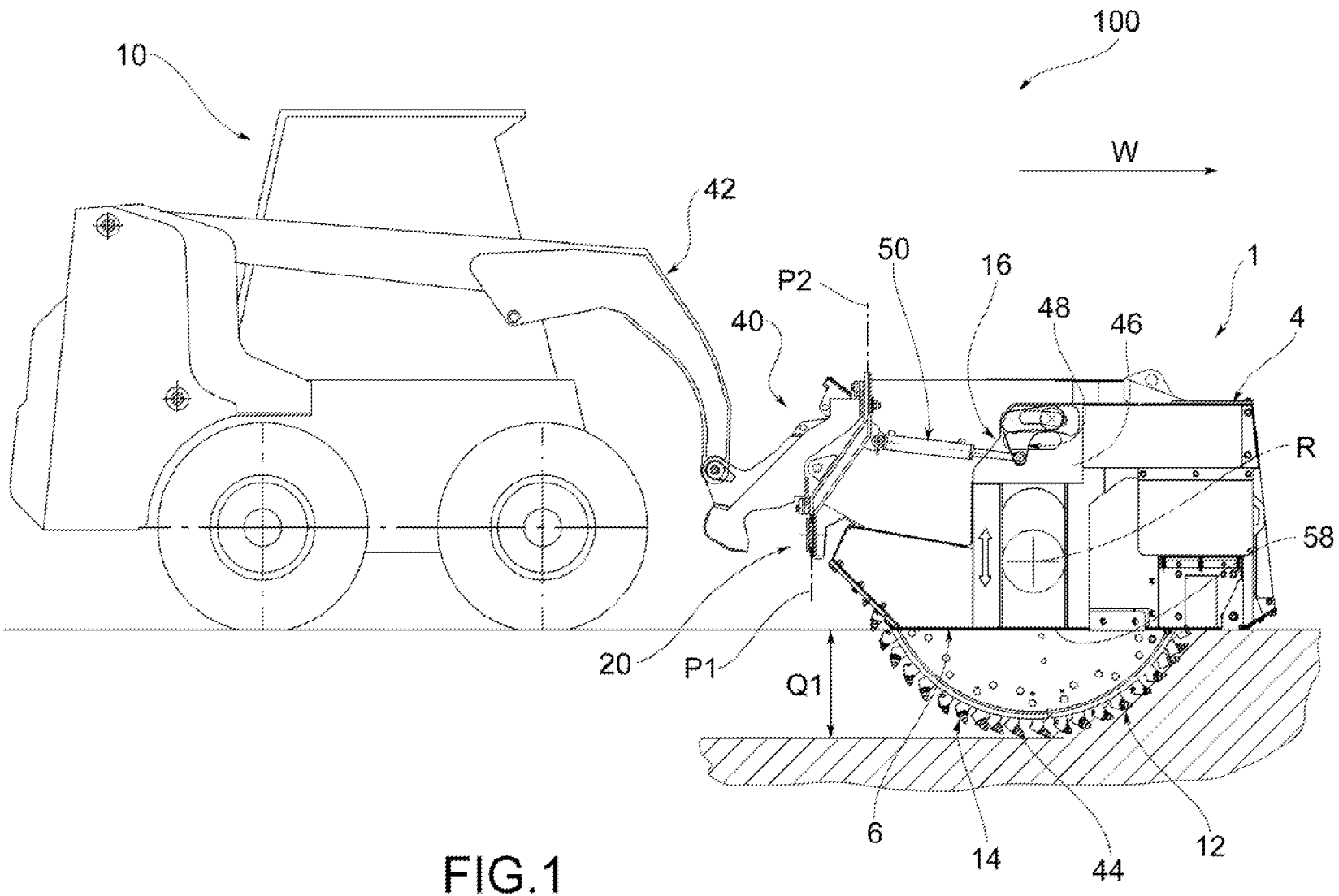
FIGS. 1, 2 show side views of an assembly, object of the present invention, according to a possible embodiment, in which the excavation tool, or digging tool, is arranged at different excavation depths Q1, Q2.

With reference to the tables above, reference numeral 1 denotes, as a whole, an equipment for an operating machine.

According to an embodiment, such equipment is a trench digging equipment.

According to an embodiment, such equipment is a milling equipment.

Such digging equipment 1 comprises a coupling portion 2 to the operating machine 10, an equipment body 4, an excavation tool 12, articulation means 20 and optional adjustment means 16 of the excavation depth Q1, Q2.

According to an embodiment, the coupling portion 2 comprises one or more translation guides 54, 56 which extend parallel to the thickness of the excavation tool 12, to allow a lateral displacement of the excavation tool 12, for example laterally with respect to a longitudinal middle line plane U of the operating machine 10.

The equipment body 4 comprises a pair of abutment runners 6 against a working surface Z.

In the tables, only one of such runners is clearly visible, the opposite runner being arranged on the hidden side of the equipment 1, advantageously aligned with the visible one.

Such equipment 1 can therefore be moved in a working direction W by virtue of the sliding contact between the abutment runners 6 and the working surface Z.

According to an embodiment, the abutment runners 6 are arranged side by side with the excavation tool 12.

According to one embodiment, the abutment runners 6 are made with folded metal sheets.

The digging tool 12 is mounted supported on an inner frame 101 which movably supports an outer frame, forming said equipment body 4; said excavation tool is supported in a movable manner around a rotation axis R and projecting partially frontally of the abutment runners 6, therefore in operation below the outer frame or equipment body 4.

Figure 2:
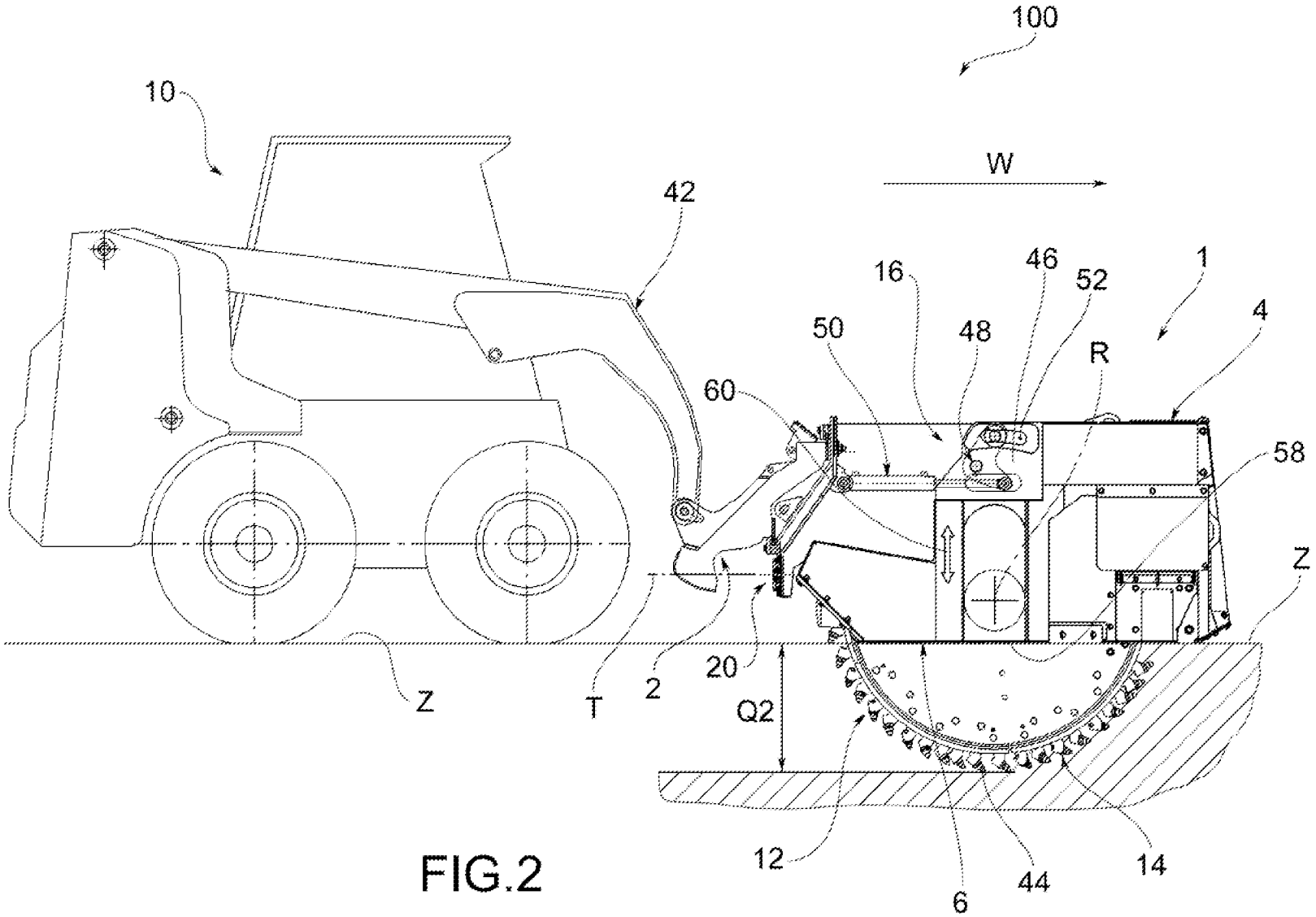
Figure 4:
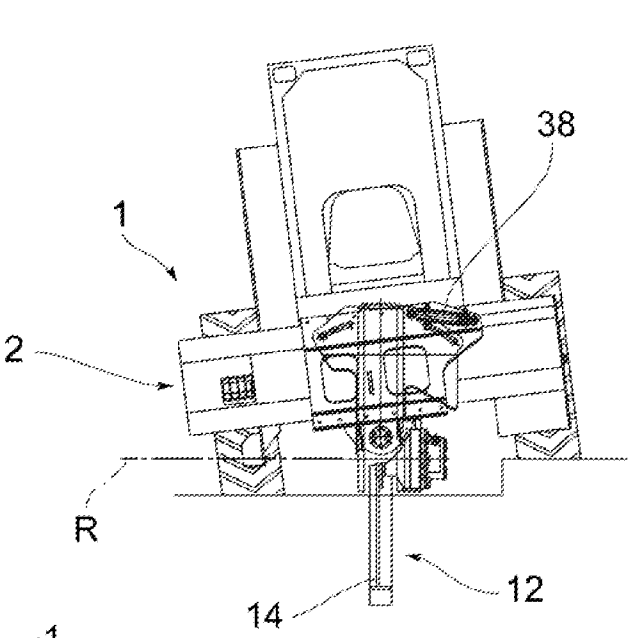
FIGS. 3, 4, 5 show front views of the excavation assembly according to a variant of the present invention, partially in section, in three different positions of the rotation axis R of the excavation tool with respect to the coupling portion and to the operating machine connected thereto.
Figure 5:
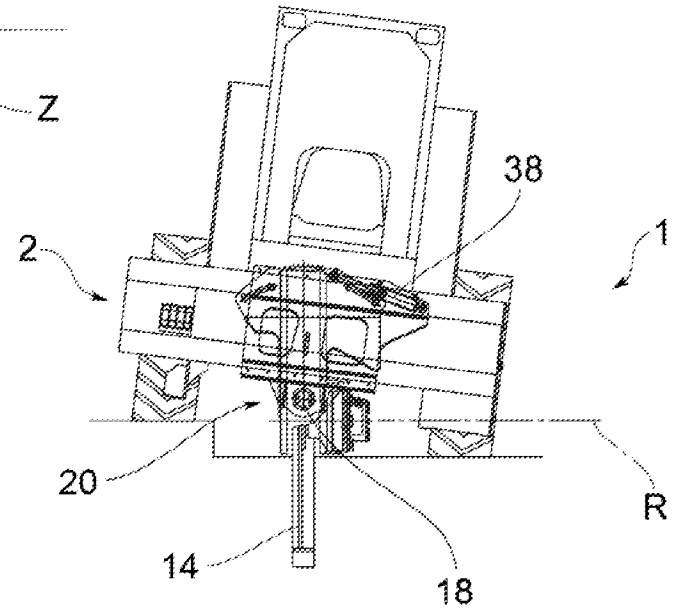

In this way, the digging tool 12 is capable of removing or digging a solid material starting from the working surface Z, for example vertically downwards according to the orientation in FIG. 1 or 2.

According to an embodiment, the excavation tool 12 is in the form of a wheel or disc.

According to an embodiment, the excavation tool 12 is in the form of a roller or a cylinder.

The excavation tool 12 peripherally comprises a plurality of excavation elements 14, for example oriented in a tangential direction with respect to the rotation axis R.

According to an embodiment, the excavation elements 14 comprise element ends 44 alternately oriented axially on opposite sides of the excavation tool 12.

According to an embodiment, the excavation tool 12 can be rotated with respect to the equipment body 4 by motor means 40.

According to an embodiment, the motor means 40 are of the hydraulic type, of the mechanical type or of the electrical type.

According to an embodiment, the adjustment means 16 of the excavation depth Q1, Q2 of the digging equipment 1 are functionally connected to the equipment body 4 and to the excavation tool 12 to adjust a relative distance between one or both abutment runners 6 and the excavation elements 14, in particular between a lower surface 58 of at least one abutment runner 6 with respect to the element ends 44.

Figure 6:
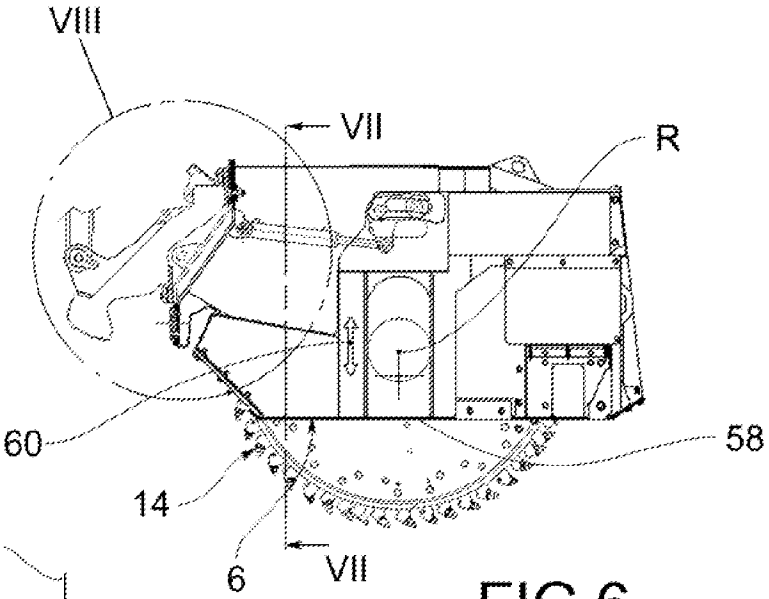
FIG. 6 shows an enlarged side view of the equipment, or apparatus, in FIG. 1.
Figure 8:
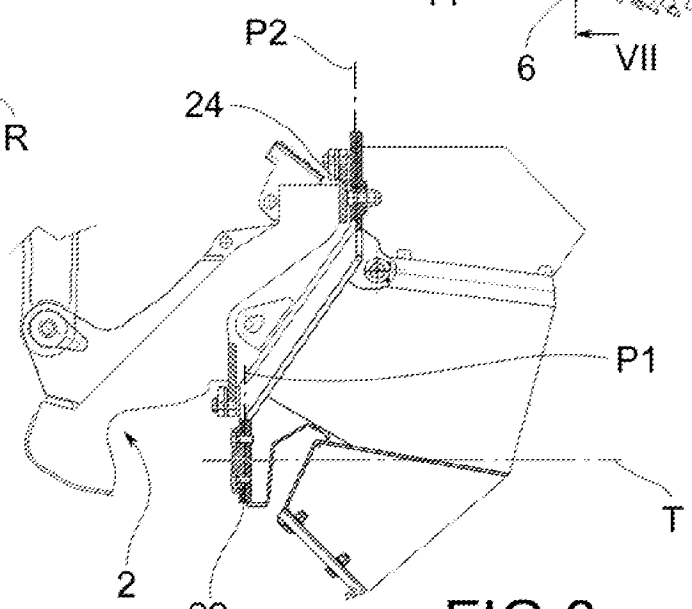
FIGS. 7, 8 respectively show a sectional front view of the equipment in FIG. 6 along the plane VII-VII indicated therein, and an enlargement of the area VIII highlighted in the same FIG. 6.
Figure 7:
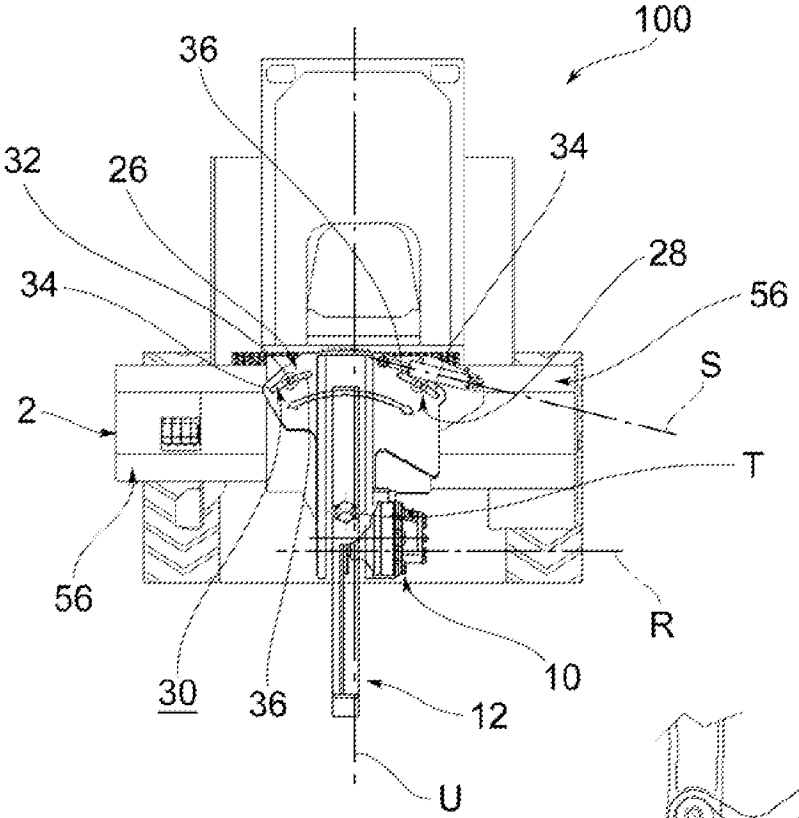

The adjustment direction is schematized by the double arrow 60 in FIGS. 2 and 6.

According to an embodiment, the motor means 40 are engaged with and are movable along, the excavation tool 12 by the adjustment means 16 of the excavation depth Q1, Q2.

According to an embodiment, the adjustment means 16 comprise a translation support 46 of the excavation tool, an adjustment arm 48 and an actuator 50 (optionally linear) connected to the equipment body 4.

More precisely, the actuator 50 is pivoted on one side to the equipment body 4 and on the other side to the adjustment arm 48. The adjustment arm 48 is in turn pivoted with the translation support 46 and is slidably mounted along a sliding guide 52 of the equipment body 4, for example in the form of a curved slot.

In this way, following a force exerted by the actuator 50—for example following an approaching or moving away of the opposite parts thereof—such an actuator 50 rotates the adjustment arm 48 in a direction such as to cause a lifting or a lowering of the translation support 46 with respect to the equipment body 4 (by virtue of the consequent sliding of such an arm 48 along the sliding guide 52), and therefore a corresponding movement of the excavation tool 12.

This type of adjustment means 16 has been discussed only by way of example. Other ways of adjusting the excavation depth according to other embodiments are possible.

The articulation means 20 are mechanically interposed between the coupling portion 2 and the excavation tool 12 to allow the rotation axis R to move about a tilting axis T, incident or orthogonal with respect to the rotation axis R.

Therefore, as discussed above, the articulation means are configured to allow desired orientations of the rotation axis R, so that the excavation tool is oriented satisfactorily in any contingency.

According to an embodiment, the articulation means 20 are adjustable or manageable to maintain a substantially horizontal orientation of the rotation axis R, for example despite a possible lateral unbalancing of the coupling portion 2 and of the operating machine 10 connectable to such a portion 2.

Figure 3:
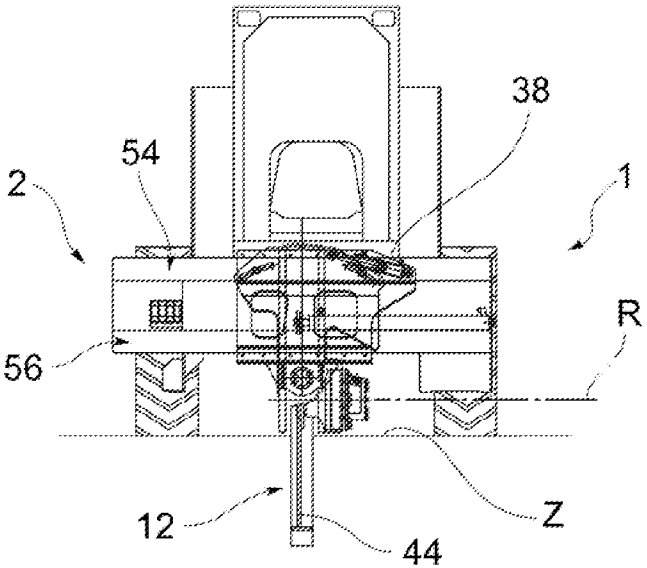

In this regard, see the examples in FIG. 3, 4, 5.

According to an embodiment, the tilting or pivoting axis T is arranged substantially parallel to a working direction W of the digging equipment 1, or parallel to a longitudinal direction of the operating machine 10.

According to an embodiment, the articulation means 20 are integrated between the coupling portion 2 and the equipment body 4.

According to an embodiment, the articulation means 20 comprise a rotation fulcrum 18 between the coupling portion 2 and the equipment body 4.

According to an embodiment, the articulation means 20 comprise at least one pair of sliding or guide surfaces 22, 24 delimited by the coupling portion 2 and by the equipment body 4, and radially spaced from the tilting axis T to guide the tilting movement.

These pairs of surfaces 22, 24 are therefore in mutual contact to accompany the tilting movement of the equipment body 4.

According to an embodiment, the digging equipment 1 comprises internal sliding surfaces 22 which develop—for example annularly—around the rotation fulcrum 18.

It should be noted that the expressions "internal" and "external" will be understood in a radial direction with respect to the tilting axis T, unless this is otherwise specified. Moreover, these expressions will have an exclusively relative meaning, in the sense that a surface defined as internal will be more internal with respect to a surface defined as external.

According to an embodiment, the digging equipment 1 comprises external sliding surfaces 24, radially offset with respect to the internal sliding surfaces 22 and which, according to a variant—extend in the form of a circular sector around the rotation fulcrum 18.

According to an embodiment, the digging equipment 1 comprises the internal sliding surfaces 22 and the external sliding surfaces 24, which extend in sliding planes P1, P2 substantially orthogonal to the tilting axis T.

According to an embodiment, the sliding planes P1, P2 are substantially parallel or coincident.

According to an embodiment, the sliding surfaces P1, P2 are axially spaced with respect to the tilting axis T.

According to an embodiment, the external sliding surfaces 24 outstrip the internal sliding surfaces 22 in the working direction W of the digging equipment 1.

According to an embodiment not shown, the internal sliding surfaces outstrip the external sliding surfaces in the working direction W of the digging equipment 1.

According to an embodiment, the digging equipment 1 comprises guide means 26, 28 of the equipment body 4 in different tilting positions.

The "tilting positions" are therefore the positions that the excavation tool 12 and the equipment body 4 reach as a result of the rotation around the tilting axis T.

According to an embodiment, the guide means 26, 28 develop in a substantially arched way around the tilting axis T and, in particular, are centered on the tilting axis T.

According to an embodiment, the guide means 26, 28 comprise at least one guide slot 30 (for example a pair of slots 30, optionally opposed to each other) formed at the equipment body 4 or at the coupling portion 2, and at least one guide pin 32 connected to the coupling portion 2 or to the equipment body 4, slidably received in the guide slot 30.

According to an embodiment, end edges 34, 36 of the guide slot 30 provide end-stroke elements for the guide pin 32, in particular in limit tilting positions.

According to an embodiment not shown, the guide means comprises a guide member at the equipment body 4 or at the coupling portion 2, delimiting a recess wherein a guide wall of the coupling portion 2 or of the equipment body 4 is slidingly inserted.

According to an embodiment, the guide member may comprise an open box-like structure.

According to an embodiment, the articulation means 20 comprise at least one first actuator 38, optionally linear, acting in thrust or in traction between the coupling portion 2 and the equipment body 4, and configured to move the latter in the different tilting positions.

According to an embodiment, the first actuator 38 works in a tangential direction S with respect to the tilting axis T, in at least one working position thereof.

According to an embodiment, the articulation means comprise a non-linear actuator.

According to an embodiment, the articulation means comprise a pinion and sprocket wheel/crown system reciprocally meshed—to move the equipment body 4 to the different tilting positions.

The aforementioned objects are also achieved by a digging assembly 100 comprising an operating machine 10 and a digging equipment 1, according to any one of the embodiments illustrated above, fixed to a movable arm 42 or to a support of the operating machine 10.

According to an embodiment, the operating machine 10 may comprise a fluid power take-off for supplying the hydraulic motor means 40.

According to an embodiment, the operating machine 10 may comprise a power outlet for supplying the mechanical motor means 40.

According to an embodiment, the operating machine 10 may comprise supply means for supplying the electric motor means 40.

According to an embodiment, the operating machine 10 may be or comprise a skid-steer machine.

Innovatively, the equipment and the assembly object of the present invention allow overcoming the drawbacks of the prior art.

More precisely, the described equipment allows varying the tilting of the rotation axis of the tool to remove material in a different way depending on the arrangement of the coupling portion.

Advantageously, the equipment and the assembly object of the present invention allow an additional degree of freedom (the tilting degree precisely) with respect to conventional machines, without however markedly displacing the center of gravity of the assembly away from the operating machine.

Advantageously, the equipment object of the present invention allows maintaining reduced dimensions in a longitudinal direction.

This allows an operator of the operating machine, when the equipment is in the parking position (that is to say, when the tool is placed above the working surface), to be able to exit freely from the passenger compartment, without this equipment constituting an obstacle when opening a front door thereof.

Moreover, this feature allows increasing the productivity of a single operator, who can carry out replacement of the digging equipment on his own without the support of other workers.

Advantageously, the equipment object of the present invention is extremely solid, and therefore suitable to withstand without any damage the excavation stresses despite the increased degrees of freedom.

Advantageously, the equipment object of the present invention has a reliable tilting movement, and precise limit switch positions.

Advantageously, the equipment object of the present invention is connected in a dismountable or demountable manner from the operating machine, through simple operations.

Advantageously, the equipment object of the present invention maintains the degrees of freedom of the traditional machines, including the lateral displacement of the excavation tool.

A person skilled in the art may make several changes or replacements of elements with other functionally equivalent ones to the embodiments of the above equipment and operating machine in order to meet specific needs.

Also such variants are included within the scope of protection as defined by the following claims.

Moreover, each variant described as belonging to a possible embodiment may be implemented independently of the other variants described.

Thanks to each of the embodiments described above, contrary to the solutions of the prior art where the arrangement of the sliding surfaces 22, 24 defining the sliding surfaces P1 and P2 coincide and are coplanar, in the solutions proposed herein the sliding planes are mutually spaced apart.

The provision of offset sliding surfaces P1 and P2 and of the rotation fulcrum 18 allows raising the excavation tool 12 and placing it resting on the plane where the operating machine 10 is placed without the arms of the operating machine 10 obstructing the operator's free exit from the operating machine, or rather from the cab of the operating machine.

Furthermore, the provision of the offset and parallel sliding planes P1 and P2, as well as the horizontal rotation axis T allows having the maximum maneuverability and ease of use of the digging equipment 1 and of the assembly 100 of the digging equipment 1 and operating machine 10.

LIST OF REFERENCE NUMERALS

1 Digging equipment
2 Coupling portion
4 Equipment body
6 Abutment runner
10 Operating machine
12 Excavation tool
14 Excavation element
16 Adjustment means
18 Rotation fulcrum
20 Articulation means
22 Internal sliding surfaces
24 External sliding surfaces
26 Guide means
28 Guide means
30 Guide slot
32 Guide pin
34 End edge
36 End edge
38 First actuator
40 Motor means
42 Movable arm
44 Element end
46 Translation support
48 Adjustment arm
50 Second actuator
52 Slide guide
54 Translation guide
56 Translation guide
58 Lower surface
60 Adjustment direction
100 Excavation assembly
P1 Sliding plane
P2 Sliding plane Q1 Excavation depth
Q2 Excavation depth
R Rotation axis
S Tangential direction
T Tilting axis
U Longitudinal middle line plane
W Working direction
Z Working surface

What is claimed is:

1. A digging equipment for an operating machine, the digging equipment comprising:

a coupling portion to couple the digging equipment to the operating machine;

an equipment body comprising a pair of abutment runners suitable to abut against a working surface;

a digging tool mounted on an inner frame and supported by said inner frame, the inner frame being movable with respect to an outer frame, said inner frame and said outer frame forming said equipment body, said digging tool being movably mounted around a rotation axis (R), projecting partially downwardly of the pair of abutment runners, in operation below the outer frame or equipment body, and peripherally comprising a plurality of excavation elements;

adjustment means of excavation depth, functionally connected to the equipment body and to the digging tool to adjust a relative distance between the pair of abutment runners and the plurality of excavation elements;

articulation means, mechanically interposed between the coupling portion and the digging tool to allow the rotation axis (R) to move about a tilting axis (T), intersecting or orthogonal to the rotation axis (R);

said articulation means comprising a rotation fulcrum between the coupling portion and the equipment body;

said articulation means further comprising at least two pairs of sliding surfaces, said at least two pairs of sliding surfaces being delimited by the coupling portion and by the equipment body, said at least two pairs of sliding surfaces being radially spaced with respect to the tilting axis (T) to guide a tilting movement;

each pair of sliding surfaces of said at least two pairs of sliding surfaces being in mutual contact to accompany the tilting movement of the equipment body;

said at least two pairs of sliding surfaces comprising a pair of internal sliding surfaces and a pair of external sliding surfaces, the pair of external sliding surfaces being radially offset with respect to the pair of internal sliding surfaces, said pair of internal sliding surfaces and said pair of external sliding surfaces developing in sliding planes substantially orthogonal to the tilting axis (T), said sliding planes being axially spaced with respect to said tilting axis (T), wherein the pair of external sliding surfaces outstrip the pair of internal sliding surfaces in a working direction of the digging equipment.

2. The digging equipment of claim 1, wherein the articulation means are adjustable or manageable to maintain a substantially horizontal orientation of the rotation axis (R), despite lateral unbalancing of the coupling portion and of the operating machine connectable to said coupling portion.

3. The digging equipment of claim 1, wherein the tilting axis (T) is arranged substantially parallel to the working direction of the digging equipment.

4. The digging equipment of claim 1, wherein the articulation means are integrated between the coupling portion and the equipment body.

5. The digging equipment of claim 1, wherein the pair of internal sliding surfaces develops annularly around the rotation fulcrum, and the pair of external sliding surfaces develops in a circular sector form around said fulcrum.

6. The digging equipment of claim 1, further comprising guide means of the equipment body in different tilting positions, said guide means arcuately extending around the tilting axis (T).

7. The digging equipment of claim 6, wherein the guide means comprise at least one guide slot made at the equipment body or at the coupling portion, and at least one guide pin connected to the coupling portion or to the equipment body, slidably housed in the at least one guide slot, end edges of the at least one guide slot forming end-stroke elements for the at least one guide pin.

8. The digging equipment of claim 6, wherein the guide means further comprises a guide member at the equipment body or at the coupling portion, delimiting a recess wherein a guide wall of the coupling portion or of the equipment body is slidingly inserted.

9. The digging equipment of claim 1, wherein the articulation means comprise at least one first linear actuator acting in thrust or in traction between the coupling portion and the equipment body, in a tangential direction with respect to the tilting axis (T), and configured to move the equipment body in different tilting positions.

10. The digging equipment of claim 1, wherein the articulation means comprise a non-linear actuator, comprising a system with a pinion and a toothed wheel/crown for moving the equipment body into different tilting positions.

11. The digging equipment of claim 1, wherein the digging tool is rotatable with respect to the equipment body by motor means, including of hydraulic, mechanical or electrical type, said motor means being engaged with, and being movable integrally with, the digging tool by the adjustment means of the excavation depth.

12. A digging assembly comprising:

an operating machine; and a digging equipment, according claim 1, fixed to a movable arm or to a support of the operating machine.

13. The digging assembly of claim 12, wherein said digging equipment is placed in front of said operating machine so that said digging equipment precedes said operating machine in a working direction.

* * * * *